United States Patent [19]

Ferry et al.

[11] 4,080,272

[45] Mar. 21, 1978

[54] CATHODIC PROTECTION METHOD AND APPARATUS

[75] Inventors: Charles R. Ferry; Mitchell F. Peterson, both of Houston, Tex.

[73] Assignee: Harco Corporation

[21] Appl. No.: 772,440

[22] Filed: Feb. 28, 1977

[51] Int. Cl.[2] ..... C23F 13/00

[52] U.S. Cl. ..... 204/147; 204/196

[58] Field of Search ..... 204/196, 147, 231

[56] References Cited

U.S. PATENT DOCUMENTS

| | | | |
|---|---|---|---|
| 2,021,519 | 11/1935 | Polin | 204/196 |
| 2,759,887 | 8/1956 | Miles | 204/196 |
| 2,987,461 | 6/1961 | Sabins | 204/196 |
| 2,998,371 | 8/1961 | Sabins | 204/196 |
| 3,129,154 | 4/1964 | Fry | 204/196 |
| 3,143,670 | 8/1964 | Husock | 204/196 |
| 3,371,023 | 2/1968 | Banks et al. | 204/196 |
| 3,375,183 | 3/1968 | Banks et al. | 204/196 |
| 3,378,472 | 4/1968 | Banks et al. | 204/196 |
| 3,634,222 | 1/1972 | Stephen, Jr. | 204/196 |
| 3,953,742 | 4/1976 | Anderson | 204/196 |

*Primary Examiner*—T. M. Tufariello

*Attorney, Agent, or Firm*—Pravel, Wilson & Gambrell

[57] ABSTRACT

Method and apparatus for determining the true cathode polarization potential for automatically regulating the impressed current in a cathodic protection system.

13 Claims, 3 Drawing Figures

CATHODIC PROTECTION METHOD AND APPARATUS

BACKGROUND OF THE INVENTION

This invention relates to the field of cathodic protection systems and method and in particular for determining the true cathode polarization potential in the system.

The use of cathodic protection systems to protect a cathode metal in contact with an electrolyte fluid is well known. Generally, cathodic protection systems are of two types — sacrificial anode or impressed current.

The sacrificial anode relies upon the natural difference in electrical potential between a cathode and an anode to sacrifice or consume the anode to protect the cathode. As such systems rely upon the natural difference in potential there is no need to measure and compensate for changes in the electrical potential between the anode and cathode.

The latter type — impressed current — usually relies upon a rectifier to supply an impressed electrical direct current between the anode and cathode, but other sources of direct current may be used. For examples, see *Control of Pipeline Corrosion* by A. W. Peabody, copyrighted 1967 by, and available from, the National Association of Corrosion Engineers, 2400 West Loop South, Houston, Tex., 77027.

In general, the direct current impressed current producing rectifiers are powered by either 3-phase or single-phase alternating current (hereinafter AC) that is usually reduced in voltage by a transformer before being rectified into a direct current (hereinafter DC) output of a desired type. Normally, electrical current rectification is done by either a selenium or silicon rectifying disc or diode to attain the overall DC voltage output desired.

Impressed current systems may also be used to protect an anodic pasivation system such as disclosed in Bank, et al U.S. Pat. Nos. 3,378,472; 3,375,183; and 3,371,023.

Precise control of the impressed current in a cathodic protection system is not only highly desirable, but a prime requirement. Early impressed current cathodic protection systems, for instance that disclosed in U.S. Pat. No. 2,176,514, lacked means for adjusting the impressed current to a changing environment. If the impressed current used was less than that required by the system, undesired corrosion of the cathode resulted. If on the other hand, the impressed current used exceeded the system requirements electrical power was wasted and paint "blistering" or other damage to the cathode's protective coating results.

Earlier attempts to solve those problems used precise electrical output apparatus such as that disclosed in U.S. Pat. Nos. 2,332,955; 2,584,816, and 2,368,264.

However, it was quickly recognized that the cathodic protection system reference or natural voltage was varied by a number of factors, such as the metal to be protected and the environmental conditions and which changed from time to time. To compensate for such changes the rectifier output of direct current was made adjustable. Some were manually adjustable as disclosed in Polin U.S. Pat. No. 2,021,519. Examples of automatically adjusting cathodic protection systems are disclosed in U.S. Pat. Nos. 1,891,005; 2,759,887; and 3,143,670, while U.S. Pat. Nos. 1,142,858 and 1,438,946 disclose general purpose output self-adjusting electrical apparatus. This automatic control or adjustment has usually been achieved in the prior art using saturable reactor control or with a silicon controlled rectifier (hereinafter SCR). For additional information, see the August 1968 article by one of the inventors of the present invention at pages 26–29 of *Materials Protection*, available from the National Association of Corrosion Engineers at the above address.

In U.S. Pat. Nos. 2,986,512; 2,982,714; 2,987,461; and 2,998,371, all to Sabins, there is disclosed a number of control systems for automatically controlling the impressed current rectifier output. Another example employing transistors may be found in Andersen, et al, U.S. Pat. No. 3,953,742 or Rubelman U.S. Pat. No. 3,373,100.

U.S. Pat. No. 3,129,154 discloses a compensating method of controlling the impressed current in which a known electromotive force is made opposed to the unknown reference electromotive force. In such arrangement, the electrical current flow through the reference circuit is minimized and polarization of the reference electrode, as well as the resulting deterioration, is minimized.

U.S. Pat. No. 3,634,222 disclosed an improved cathodic protection automatic control system in which the true cathode polarization potential could be determined using the "instant off" method. While such system does eliminate some of the error in determining the true potential, the system employed a sequential controller that was subject to failure and periodically interrupted the operation of the cathodic protection of the system.

SUMMARY OF THE INVENTION

This invention relates to a new and improved sampling and control system for cathodic protection systems.

An improved method and apparatus for determining the true cathode polarization potential in a cathodic protection system. A system synchronizer electronically connected with the alternating current driving the cathodic protection rectifier times the reading of the cathode polarization potential by the reference electrode at the zero direct current output period of the full wave rectified direct current output of the rectifier.

DESCRIPTION OF THE PREFERRED EMBODIMENT

Figure 1:
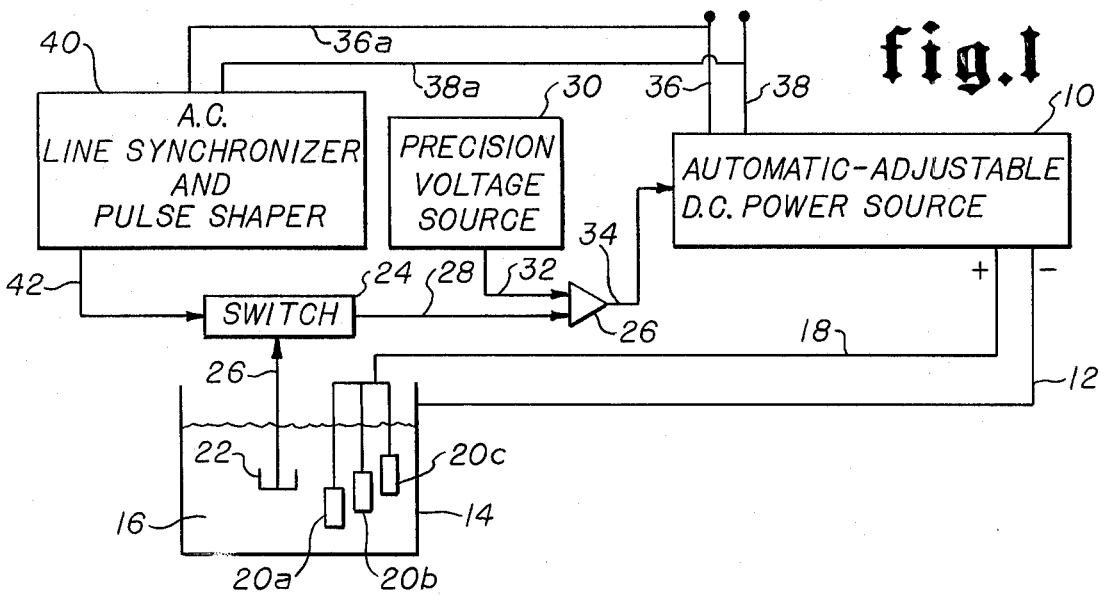
FIG. 1 is a diagrammatic illustration of the cathodic protection system of the present invention.

Referring now to FIG. 1, the cathodic protection system of the present invention is illustrated schematically. The automatic adjustable direct current power source 10 has its negative direct current output connected through electrical conductor 12 to the cathode 14 which is illustrated as the tank containing electrolyte 16 such as water. The positive direct current output of the system impressed current source 10 is connected through electrical conductor 18 to anodes **20*a*, 20*b* and 20*c*. While a plurality of anodes 20*a*, 20*b* and 20*c*** are illustrated schematically connected electrically in parallel, it is to be understood that a single anode may be employed.

The current flow in the electrolyte is such that the anodes are sacrificed to protect the cathode 14 from corrosion by the electrolyte 16 in the known manner.

It is to be understood that the cathode 14 could also be a pipeline, an offshore platform, a ship hull or any other metal structure that it is desirable to protect from corrosion when exposed or in contact with an electrolyte 16.

A reference electrode 22 is disposed in the electrolyte 16 at a desired position and is electrically connected with an electronic switch means 24 through electrical conduit 26. When the electronic switch 24 is actuated the signal from the reference electrode 22 is conducted through the switch 24 to an amplifier means 26 through electrical conduit or wire 28. The amplifier 26 is supplied with direct current electrical power from a precision voltage source 30 through electrical conductor 32 for amplifying the difference between the desired reference voltage and the actual reference voltage. The output signal from the amplifier 26 is then communicated through electrical conductor 34 to the automatic adjustable source 10 for controlling the impressed direct current output of the source 10 in the known manner.

The source 10 is supplied from the source of single phase alternating current, usually 60 Hertz, through conductors 36 and 38 such as 120 or 230 vols in the usual manner. Branch alternating current conductors **36*a* and 38*a* communicate with an alternating current synchronizer and pulse shaper unit schematically referenced as 40. The output signal of the synchronizer and pulse shaper 40 is communicated through electrical conduit 42 to the electronic switch 24 for effecting its operation in a synchronized manner with the cathodic protection rectifier 10**.

Figure 3:
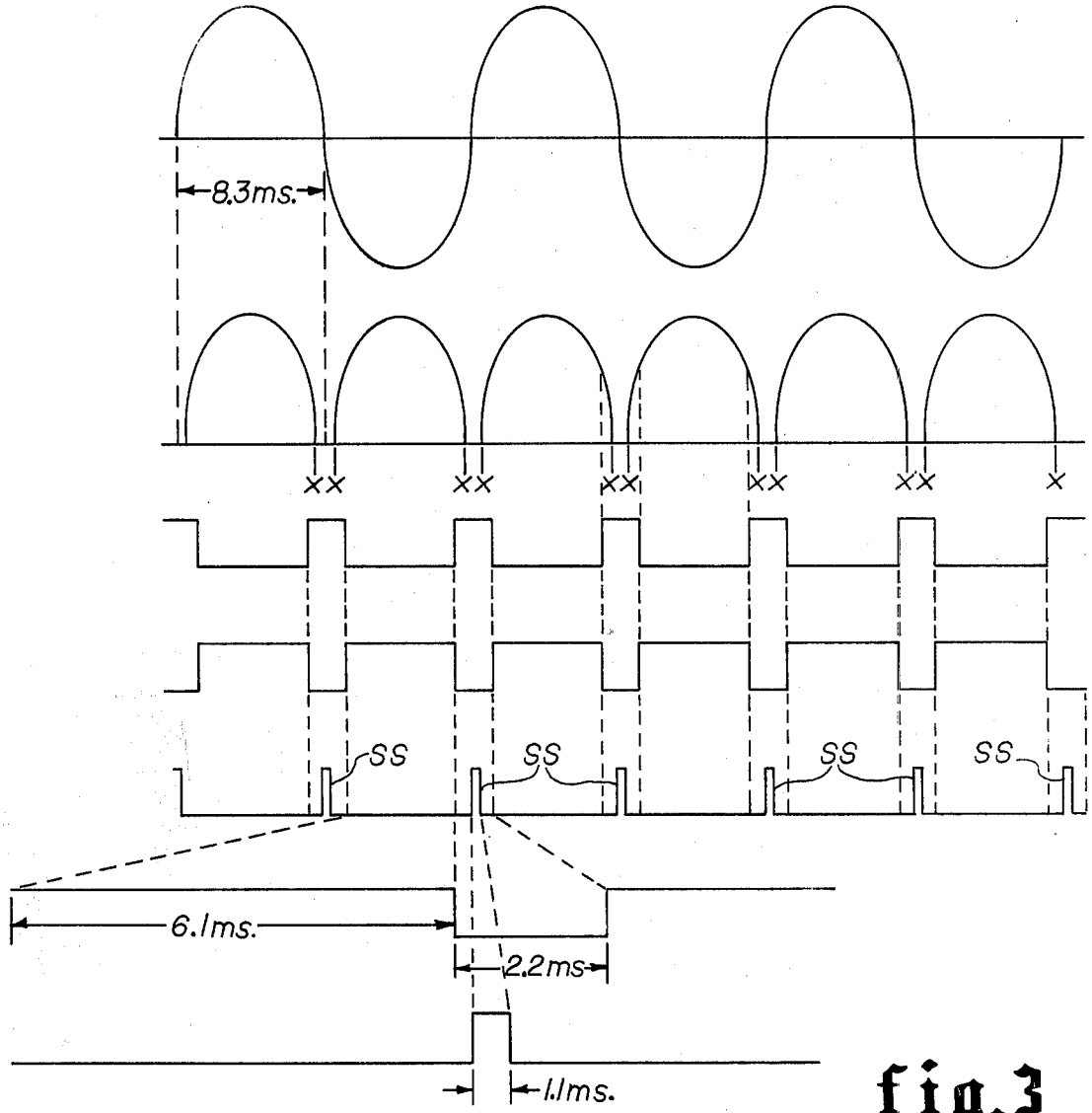
FIG. 3 is a schematic view of the wave forms of the electrical signals utilized in the present invention.
Figure 2:
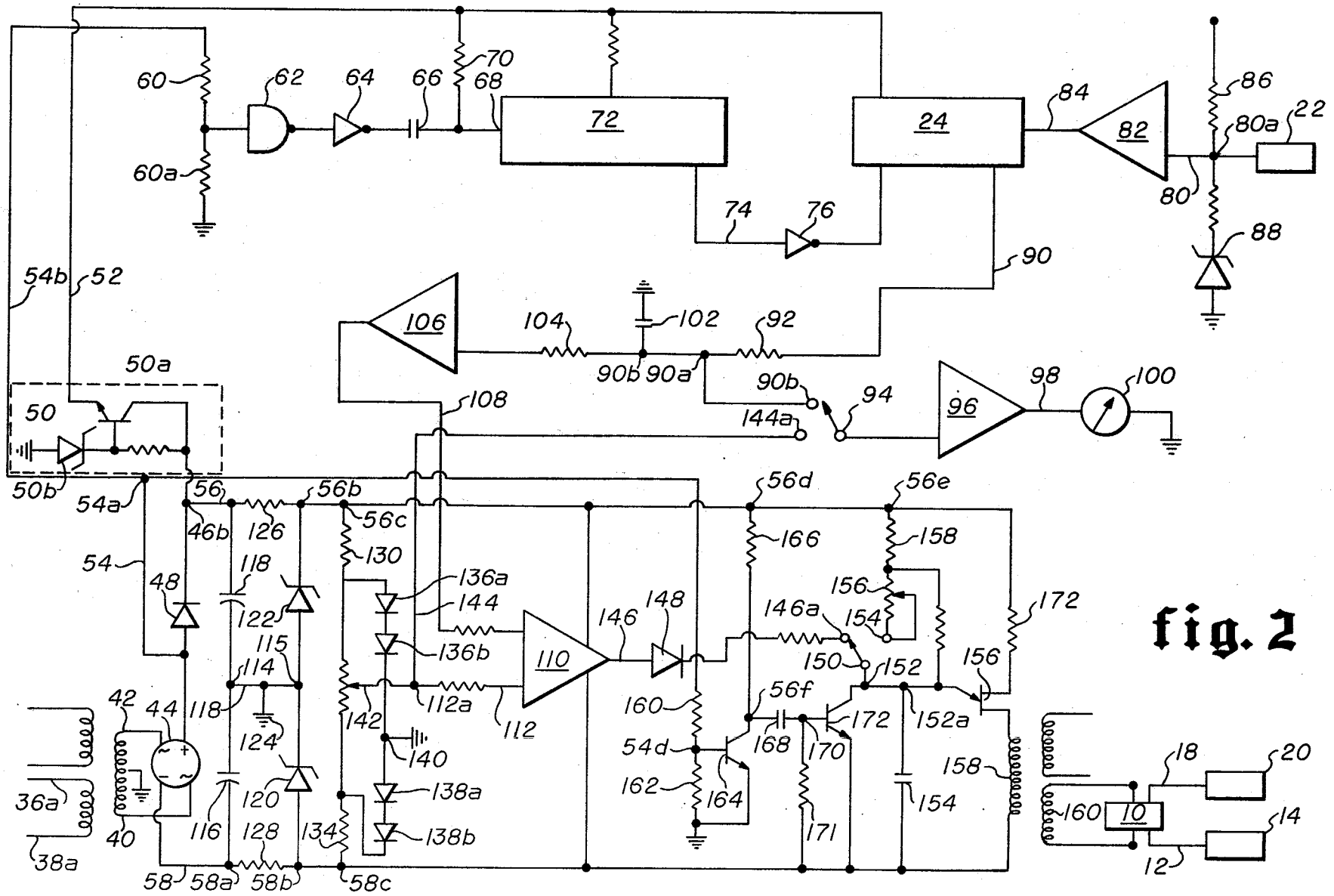
FIG. 2 is a schematic circuit diagram of the controller of the cathodic protection system of the present invention.

Referring now to FIG. 2, the electrical control circuit of the present invention is there illustrated schematically. The single phase alternating current input conductors **36*a* and 38*a* are connected to the input primary winding of transformer 40 also having a secondary winding 42 for reducing the voltage of the alternating current in the usual manner. The low voltage alternating current is then passed through a full wave rectifier 44, to convert the alternating current into a rippled direct current output, which is best illustrated by comparing the wave forms of FIG. 3 in which the upper wave form is the alternating current voltage and the second wave form is the pulsating direct current voltage from the rectifier 44 which is of zero voltage for brief periods when the alternating current is changing polarity. While theoretically the single phase, full wave AC-DC rectifier output is instantaneously zero voltage and current at two points in each AC cycle, the threshold voltage of the diode bridge 44 is such that the output is zero for a small period of time. This period of time of zero output is illustrated in FIG. 3** by the time interval *x—x*.

The rippling positive direct current output of the rectifying diode circuit 44 is conducted through line or wire 46 having junction **46*a* and through blocking or isolating diode 48 and junction 46*b* to a regulator enclosed in the dotted lines 50. The regulator 50 is an NPN transistor 50*a* controlled by a Zener diode 50*b* in order to produce a desired precise direct current output voltage without the ripples through conductor 52**. For an example of such a regulator circuit see Section 7–45 of *Electronics Engineer's Handbook*, published by the Institute of Electrical and Electronics Engineers, Copyright 1975 by McGraw-Hill, Inc. The output of the regulator 50 is transmitted through conductor 52 in a manner and for voltage power supply purposes which will be described in greater detail hereinafter and which are self evident from FIG. 2.

The pulsating positive direct current from the diode rectifier 44 is also conducted from terminal **46*a* through electrical conductor 54 to the electrical junction 54*a* which separates into conductor branches 54*b* and 54*c*. The positive voltage output of the full wave rectifier 44 is also connected at junction 46*b* with electrical conductor 56 as will be described in greater detail hereinafter. The rippling negative direct current voltage output of the full wave rectifying circuit 44 is transmitted through conductor 58 to the electrical junction 58*a*** as will also be described in greater detail hereinafter.

The pulsating positive output of the rectifier circuit 44 is communicated through the conductor 54 and **54*b* from junction or terminal 46*a* to pass through a voltage divider network comprising a fixed resistor 60 and on to ground through fixed resistor 60*a*. Between the fixed resistors 60 and 60*a*, the reduced pulsating voltage direct current signal is conducted to a Schmitt trigger 62**. As is known in the art, See Section 16—35 through 16—37 of *Electronics Engineer's Handbook*, there is a voltage output from the NAND Schmitt trigger until the input to the Schmitt trigger reaches a desired preselected voltage level. The Schmitt trigger produces a square wave output signal from the pulsating DC input from the full wave rectifier 44 in the known and usual manner, which is then inverted logically in the inverter 64. Preferably, a model S5404 hex inverter manufactured by and available from Signetics Corporation of Sunnyvale, Calif. is utilized. The inverted square wave from the inverter 64 is then passed through capacitor 66 into a linear integrated circuit means 72 at terminal 68. The capacitor 66 serves to convert the inverted output signal from inverter 64 from a square wave into a precise spike wave form of positive voltage. Resistor 70 electrically connected with conductor 52 of regulator 50 insures that the spike wave from the capacitor 66 has a sufficient voltage magnitude at input 68 to actuate the linear integrated timer 72. The linear integrated sequential timer 72 is well known to those skilled in the art and preferably a commercially available Model No. 556 also manufactured by and available from Signetics Corporation of Sunnyvale, California and connected in the manner illustrated at page 6–82 of that company's Applications Manual is used. The timer 72 delays the signal for a period of approximately 1.1 milliseconds after receiving the input signal before producing an output signal of approximately 0.11 milliseconds for synchronizing the sampling of the reference electrode when the impressed current is not present.

The output signal of the linear timer 72 is communicated through the conduit 74 and another inverter 76 into the electronic switch means 24. Preferably a model DG-111 MOS-FET driver switch manufactured by Intersil Company of Sunnyvale, Calif. and disclosed at pages 181–184 of their catalog is used. When the signal is present in the line 74 and amplifier 76 the switch means 24 is closed to enable passage of the reference voltage signal through the switch 24. Thus the linear timer amplifier 72 output will determine both the initiation or start of the synchronization signal and the duration of the synchronization operation of switch 24. The timing of the initiation and length of the synchronizing signal from the timer 72, designated SS in FIG. 3, for closing the switch means 24 to enable sensing of the reference voltage can best be understood by comparing in the bottom wave form signal SS of FIG. 3 with the direct current output of the silicon controlled rectifier (SCR) 10 that is designated RR and which is also controlled by the synchronizer. The output wave form of the SCR 10 differs from that of the rectifier circuit 44 in magnitude of both voltage and amperage, but the wave form is substantially the same as that illustrated in FIG. 3 as the output of rectifier circuit 44. For ease of understanding the present invention, the full wave rectification of the alternating current as illustrated in FIG. 3 may be considered as the output of either SCR 10 or rectifier circuit 44. If the system impressed current requirements are less than that which would be supplied by full firing by the SCR 10, the output wave form will be phase controlled to provide the lesser amount of impressed current to the system, as is well known in the art.

The sample signal to the switch means 24 commences after the SCR 10 output goes to zero to enable reference reading to eliminate the IR drop between cathode and anode and the synchronizer signal terminates for breaking the reference signal reading prior to the synchronizer triggering the next pulse of direct current from the SCR 10. Thus in a 60 Hertz AC system, the synchronizer triggers the control system to read the reference voltage 120 times per second and which is effectively a continuous reading free of the anode current IR drop.

The reference electrode 22 is connected through a conductor 80 with a buffer amplifier 82 having its output in turn connected with the electronic switch 24 using the conductor 84 in order that the reference voltage electrical signal is always present at switch 24. Connected with the junction **80*a* is a resistor 86 which is connected in turn with a positive source (not illustrated) of direct current at a relatively low voltage to insure a reference voltage reading at junction 80*a* if the reference electrode 22 should fail for some reason. The junction 80*a* is also connected to ground through a Zener diode 88 to provide overload protection for the reference electrode circuit in the event a surge is sensed by the reference electrode which could damage the amplifier 82**.

When the electronic switch 24 is operated closed by the presence of the precisely controlled signal from timer 72, the reference voltage signal from the electrode 22 will be transmitted through the electronic switch 24 through conductor 90 and fixed resistor 92 to electrical junction or terminal **90*a*. The electrical terminal 90*a* is in turn connected to the two position electrical switch 94 having by an electrical switch contact 90*b* to a buffer amplifier 96 which is in turn connected to the ground through conductor 98 having a visual display volt meter 100 connected therein. When the electrical switch 94 is in position making electrical contact with the terminal 90*b* the indicated reading of the volt meter 100 will be the sensed reference voltage from the referenced electrode 22. When the switch 94 is moved to the other position the predetermined set point of the control system will be displayed on the volt meter 100** in a manner that will be described in greater detail hereinafter.

The conductor junction **90*a* is also electrically connected with the junction 90*b* having a capacitor 102 connected thereto and leading therefrom to ground. The purpose of the capacitor 102 is to store the direct current reference voltage signal for 8.3 milliseconds and to prevent loss of the reference voltage by discharging the stored charge when the electrical switch 24 opens and breaks the reference voltage circuit to the reference electrode 22. When the capacitor 102 discharges its output passes through resistor 104 into buffer amplifier 106. The output signal from the buffer amplifier 106 is conducted through the conductor 108 to a comparator or differential amplifier 110 having a manually adjustable offset to insure an output signal when there is no sensed error. The comparator amplifier 110 serves to determine difference between the reference voltage signal present in the conductor 108 with the preselected desired input conducted through the line conductor 112 to the differential or comparator amplifier 110 where the amplified difference, if any, is the output signal. As will be described in greater detail hereinafter, the reference voltage present in the conductor 112 is a manually selected reference voltage set point to which the sensed reference voltage is compared for automatically adjusting the rectifier 10** output.

The predetermined set voltage signal to which the reference voltage signal is compared is produced by first regulating the voltage potential between the positive DC junction **56*a* and negative DC junction 58*a* both of which are electrically connected in a filter network to a ground 124 and the central junctions 114 and 115. The capacitors 116 and 118 and Zener diodes 120 and 122 are arranged in the regulating network circuit in conjunction with resistors 126 and 128 to dampen out the pulsing direct current in conductors 56 and 58 and provide a constant regulated DC signal. As connector 56 is positive and connector 58 is negative the direct current voltage present at terminals 114 and 116 is essentially zero and is carried to ground at 124. The current flow through the Zener diodes 122 and 120 to ground at 124 centrals. The voltage drop across the resistors 126 and 128 to produce a substantially constant regulated positive and negative DC voltage at the junctions 56*b* and 58*b*, respectively, that is practically free of the rippling wave form. This regulated voltage is then connected to the terminals 56*c* and 58*c* of conductors 56 and 58, respectively, in the usual manner. The terminal 56*c* is connected through the fixed resistor 130 with the manually adjustable variable resistor 132 which is also connected to the junction 58*c* through fixed resistor 134. Diodes 136*a*, 136*b* and 138*a* and 138*b* are arranged in an electrical network connection around a zero voltage point 140 in order that the variable output of the resistor 132 will be taken off at manually set movable electrical contact 142 as a predetermined desired positive voltage which is conducted to electrical junction 112*a* and the comparator or differential amplifier 110 through conductor 112**.

The electrical junction **112*a* is also connected through the conductor 144 to the contact 144*a* of the two position switch 94. When the switch 94 establishes electrical contact with the contact 144*a*, the predetermined or set reading of the pickup output 142 of the manually set adjustable resistor 132 is indicated or displayed on the volt meter 100**.

As previously disclosed, the set voltage from the movable contact 142 is also communicated through the connector 112 to the comparator amplifier 110 where it is compared with the input signal from the buffer amplifier 106 and the reference electrode 22. The comparator amplifier 110 produces an output signal in conductor 146 comprising the difference of the two which is amplified and transmitted through conductor 146 and through an isolating diode 148 which prevents reverse error currents or signals returning to the comparator amplifier 110.

The conductor 146 includes a contact 146*a* that is connected by the two position manual-automatic mode control switch 150 having an output terminal 152 and which is illustrated in the automatic mode position. The switch 150 may also be placed in electrical contact with the terminal 154 when it is desired to manually set the control of the output of the rectifier 10 and override the automatic operation mode.

The switch contact or terminal 154 is electrically connected with the manually adjustable potentiometer 156 which is in turn connected through a fixed resistor 158 to the junction 56*e* of the conductor 56 for providing an operating DC voltage to the manually adjusted potentiometer 156. The manually selected DC voltage from potentiometer 156 is conducted to the contact 150 for operating the system in the same manner as the automatic mode operation signal from amplifier 110.

The signal present at the switch 150 is conducted to the output terminals 152 and 152*a* and there serves to charge the capacitor 154. When the capacitor 154 discharges through the Unijunction (UJT) transistor 156, it produces a direct current pulse through a primary coil 158 of a transformer which is picked up by the secondary coil 160 which is electrically connected with the control SCR of the source of impressed current 10 for triggering or initiating the direct current output of the source 10 and controlling its voltage to the cathode 14 and anodes 20*a*, 20*b* and 20*c* of the cathodic protection system. Such use of unijunction transistors as trigger control devices for silicon controlled rectifiers (SCR) is known in the art and described at Section 7-72 of the *Electronics Engineers Handbook.*

An electrical circuit means is provided to synchronize the changing of the capacitor 154 to provide for uniform firing of the SCR controlling the output of the source 10. To discharge capacitor 154 through UJT transistor 156, the positive ripple DC output of the rectifying circuit 44 is conducted through conductor 54*c* to a voltage divider network having fixed resistor 160 connected to junction 54*d* and then through fixed resistor 162 to ground. When a positive ripple of DC voltage and current is present at the junction 54*d* it is also conducted to the base of the NPN transistor 164 to enable current flow through the transistor 164 from the transistor collector connected to the terminal 56*f* through the transistor emitter to ground. The terminal 56*f* is in turn electrically connected with the terminal 56*d* through fixed resistor 166 for regulating the current flow through transistor 164 to ground. The terminal 56*f* is also electrically connected through the capacitor 168 with the terminal 170. The terminal 170 is electrically connected with negative voltage DC conductor 58 through fixed resistance 171 and also with the base of the NPN transistor 172. The transistor 164 prevents the electrical voltage at 56*f* from charging capacitor 168 as long as there is voltage at the terminal 54*d* and the base of the transistor 164. As the voltage present at 54*d* is a function of the ripple output pulse of the full wave rectifier 44 the responsiveness of the transistor 164 is thus also synchronized with the AC line current in the primary winding of the transformer 40 and enables the transistors 164 and 172 to synchronize the output of the transformer coil 158 with the electronic switch 24 to prevent firing of the rectifier 10 when the electronic switch 24 is closed as illustrated in FIG. 3.

When the direct current voltage signal at the junction 54*d* is so small that the current flow is blocked by the resistor 160, the DC current flow from the collector to the emitter of the transistor 164 is blocked and which enables charging of the capacitor 168. When the DC current flow is again commenced through transistor 164, the capacitor 168 produces a spike voltage wave form signal that is passed through the terminal 170 to the base of the NPN transistor 172 for enabling the current flow of the differential reference signal from the terminals 152 and 152*a* through the transistor 172 to the conductor 58. When this occurs the charged capacitor 154 discharges through the transistor 172 to negative voltage conductor 58. When the biasing current at the base of transistor 172 no longer conducts to conductor 58 and the error signal from the error comparator amplifier 110 commences to charge capacitor 154 to the error voltage. When the charge on comparator 154 reaches the firing voltage for the UJT transistor 156, the capacitor 154 through the UJT transistor 156 and pulse transformer 158 to the conductor 58. The charging time from the capacitor 154 is a function of the error signal from amplifier 110. The greater the error the sooner the UJT will conduct for initiating the firing pulse for providing the phase controlled output. When the error is zero, the amplified offset voltage from the comparator amplifier 110 will effect a partial wave firing to automatically control the output of the same 10 of impressed current. This pulse of DC current and its duration in the primary winding 158 is sensed by the secondary winding 160 which is electrically connected with the silicon controlled rectifier 10 to trigger its operation and control its output voltage.

USE AND OPERATION

In the use and operation of the present invention, the cathodic protection system is assembled in the manner illustrated in FIG. 1. The normal reference voltage of the system is then determined by any suitable measurement technique. Then the readout position switch 94 is moved to contact terminal 144*a* and the adjustable contact 142 is then moved along resistor 132 until the normal reference voltage is displayed on voltmeter 100. Switch 94 is then moved to contact terminal 90*b* to thereafter indicate the reference voltage reading of the reference electrode 22.

Operation of the control system is thereafter automatic and can be left untended for long periods of time. Operation of the automatic control system also minimizes the electrical power required to effect cathodic protection of the cathode.

In the enlarged portion of FIG. 3, the following time values are schematically illustrated. The output from inverter 64 is present for 6.1 millisecond and is then turned off for a period of 2.2 milliseconds. The signal from the timer 72 commences 1.1 millisecond after inverter output goes to zero and lasts for 0.11 milliseconds during which time the reference reading is made.

The foregoing disclosure and description of the invention are illustrative and explanatory thereof, and various changes in the size, shape, and materials as well as in the details of the illustrated construction may be made without departing from the spirit of the invention.

We claim:

1. A method of controlling an impressed current corrosion protection system, including:

impressing a controlled direct current having zero voltage periods between the output pulses of direct current in an electrolyte of a corrosion protection system;

generating an electrical timing signal of a set duration that exists only during the zero voltage periods of the output pulses of direct current;

sensing the natural reference voltage in the electrolyte of the corrosion protection system in response to the presence of the electrical timing signal;

comparing the sensed reference voltage with a preselected standard signal to determine an error control signal; and controlling the output pulses from the source of impressed current for the corrosion protection system in response to the reference voltage error signal sensed during the zero voltage output periods.

2. The method as set forth in claim 1, wherein the step of impressing includes the step of:

flowing the direct current through the electrolyte to protect the cathode of the corrosion protection system.

3. The method as set forth in claim 1, wherein the step of generating the electrical timing signal includes the steps of:

rectifying an alternating current to produce a full wave direct current signal;

forming a electrical trigger signal in response to each full wave direct current signal; and producing the electrical timing signal of set duration in response to the electrical trigger signal.

4. The method as set forth in claim 1, wherein the step of sensing includes the step of:

establishing electrical continuity through a switch means during the duration of the electrical timing signal.

5. The method as set forth in claim 1, wherein the step of comparing includes the step of:

providing an offset signal to produce an error control signal when the sensed reference voltage and the preselected standard signal are the same.

6. The method as set forth in claim 1, wherein the step of controlling includes the step of:

retarding the start of the output pulses of the impressed direct current when the sensed reference voltage and the preselected standard signal are the same to control the impressed direct current.

7. A method of determining the natural reference voltage existing in a corrosion protection system having an impressed current with zero voltage periods between output pulses of direct current in the electrolyte of the corrosion protection system, including the steps of:

generating an electrical timing signal of a set duration that exists only during the zero voltage periods of the output pulses of direct current;

sensing the natural reference voltage in the electrolyte of the corrosion protection system in response to the presence of the electrical timing signal;

indicating visually the natural reference voltage sensed during the presence of the electrical timing signal.

8. A method of determining the natural reference voltage existing in a corrosion protection system having an impressed current with zero voltage periods between output pulses of direct current in the electrolyte of the corrosion protection system, including the steps of:

rectifying an alternating current to produce full wave pulsating direct current;

sensing the direct current pulses to produce a synchronizer trigger signal;

processing the synchronizer trigger signal to produce an electrical switch closing signal having a duration during the zero voltage periods between output pulses of the impressed direct current; and closing an electronic switch means to activate a reference voltage sensing circuit in response to the presence of the electronic switch closing signal for making the natural reference voltage reading when the impressed current is in the zero voltage period.

9. The method as set forth in claim 8, including the step of:

indicating visually the natural reference voltage sensed by the activated reference voltage sensing circuit.

10. A cathodic protection system for inhibiting the corrosion of a metallic surface in contact with an electrolyte in which pulsed electrical power having zero voltage periods between pulses is continually supplied to the impressed current output circuit and which output is automatically adjusted to maintain the surface potential at a predetermined optimum to inhibit corrosion of the metallic surface, including:

an anode in contact with an electrolyte;

a metal to be cathodically protected as a cathode in contact with the electroyte;

a reference electrode in contact with the electroyte;

adjustable electric supply means for producing a controlled pulse direct current output having a zero voltage period between the output pulses of direct current;

said adjustable electric supply means electrically connected with said anode and said metal to be protected as a cathode for impressing the controlled pulse direct current in the electrolyte to inhibit the cathode from corrosion;

an electronic switch means electrically connected with said reference electrode for passing a reference voltage output signal when the controlled direct current of said adjustable electric supply means is in the zero voltage period;

means electrically connected with said switch means for comparing the reference signal from the switch means with a preselected standard signal to determine an error control signal; and means with said adjustable electric supply means for controlling the direct current output pulses of said adjustable electric supply means is response to the error control signal.

11. An automatic control system for an impressed current system for inhibiting the corrosion of a metallic surface in contact with an electrolyte in which pulses electrical power having zero voltage periods between pulses is continually supplied to the impressed current output circuit and which output is automatically adjusted to maintain the surface potential at a predetermined optimum to inhibit corrosion of the metallic surface, including:

a reference electrode in contact with the electrolyte;

adjustable electric supply means for producing an impressed current output having a controlled pulse direct current output having a zero voltage period between the output pulses of direct current;

said adjustable electric supply means electrically connected for impressing the controlled pulse direct current in the electrolyte to inhibit corrosion;

an electronic switch means electrically connected with said reference electrode for passing a reference voltage output signal when the controlled direct current of said adjustable electric supply means is in the zero voltage period;

means electrically connected with said switch means for comparing the reference signal from the switch means with a preselected standard signal to determine an error control signal; and means with said adjustable electric supply means for controlling the direct current output pulses of said adjustable electric supply means in response to the error control signal.

12. The apparatus as set forth in claim 11, including:

means for visually displaying the value of the reference voltage from the reference electrode.

13. The apparatus as set forth in claim 11, including:

means for controlling the mode of operation of the control system by substituting a manually prechosen signal for the error control signal.

* * * * *